US011300341B2

(12) United States Patent
Senf, Jr.

(10) Patent No.: US 11,300,341 B2
(45) Date of Patent: Apr. 12, 2022

(54) METHOD OF CONTROL FOR ECONOMIZER OF TRANSPORT REFRIGERATION UNITS

(71) Applicant: Carrier Corporation, Palm Beach Gardens, FL (US)

(72) Inventor: Raymond L. Senf, Jr., Central Square, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/620,206

(22) PCT Filed: Jun. 7, 2018

(86) PCT No.: PCT/US2018/036500

§ 371 (c)(1),
(2) Date: Dec. 6, 2019

(87) PCT Pub. No.: WO2018/226986

PCT Pub. Date: Dec. 13, 2018

(65) Prior Publication Data

US 2020/0116407 A1 Apr. 16, 2020

Related U.S. Application Data

(60) Provisional application No. 62/516,947, filed on Jun. 8, 2017.

(51) Int. Cl.

*F25B 49/02* (2006.01)
*F25B 1/047* (2006.01)

(Continued)

(52) U.S. Cl.

CPC ..... *F25B 49/025* (2013.01); *F25B 1/047* (2013.01); *F25B 41/22* (2021.01); *F25B 49/02* (2013.01);

(Continued)

(58) Field of Classification Search

CPC ..... F25B 2400/13; F25B 2500/27; F25B 2600/25; F25B 2600/2509; F25B 2600/2513; F25B 2700/21172

See application file for complete search history.

(56) References Cited

U.S. PATENT DOCUMENTS 2,739,450 A 3/1956 Breck
4,257,795 A 3/1981 Shaw (Continued)

FOREIGN PATENT DOCUMENTS

CN 1513103 A 7/2004
CN 102220964 A 10/2011

(Continued)

OTHER PUBLICATIONS

Anonymous: Refrigeration & Air Conditioning Division Fitters Notes Hints and Tips for the Installer Manual Making Modern Living Possible.

(Continued)

*Primary Examiner* — Jonathan Bradford
(74) *Attorney, Agent, or Firm* — Cantor Colburn LLP

(57) ABSTRACT

A method of operating a refrigeration system includes initiating a compressor shutdown operation, determining a difference in a saturation temperature at a port of a compressor of the refrigeration system and an ambient temperature and comparing the difference in the saturation temperature and ambient temperature with a threshold. If the difference in the saturation temperature and ambient temperature is less than or equal to the threshold, a pump down operation is performed and if the difference in the saturation temperature and ambient temperature exceeds the threshold, a compressor shutdown operation is completed.

16 Claims, 3 Drawing Sheets

(51) Int. Cl.

| | |
|---|---|
| ***F25B 41/22*** | (2021.01) |
| *F25B 1/04* | (2006.01) |
| *F25B 41/385* | (2021.01) |

(52) U.S. Cl.

CPC ..... *F25B 1/04* (2013.01); *F25B 41/385* (2021.01); *F25B 2400/13* (2013.01); *F25B 2400/19* (2013.01); *F25B 2500/27* (2013.01); *F25B 2500/28* (2013.01); *F25B 2600/25* (2013.01); *F25B 2600/2509* (2013.01); *F25B 2600/2513* (2013.01); *F25B 2700/2106* (2013.01); *F25B 2700/21151* (2013.01); *F25B 2700/21172* (2013.01)

(56) References Cited

U.S. PATENT DOCUMENTS

| | | | | |
|---|---|---|---|---|
| 4,448,038 | A * | 5/1984 | Barbier | F25B 41/062 62/212 |
| 4,718,246 | A * | 1/1988 | Mitchell | F25B 49/022 62/208 |
| 4,966,013 | A * | 10/1990 | Wood | F04B 49/10 62/193 |
| 5,095,712 | A | 3/1992 | Narreau | |
| 5,157,933 | A | 10/1992 | Brendel | |
| 5,400,609 | A | 3/1995 | Sjoholm et al. | |
| 5,410,889 | A | 5/1995 | Sjoholm et al. | |
| 5,983,660 | A | 11/1999 | Kiessel et al. | |
| 6,042,344 | A | 3/2000 | Lifson | |
| 6,085,533 | A * | 7/2000 | Kaido | F25B 49/022 62/196.2 |
| 6,374,631 | B1 | 4/2002 | Lifson et al. | |
| 6,385,981 | B1 | 5/2002 | Vaisman | |
| 6,619,057 | B2 | 9/2003 | Williamson et al. | |
| 6,745,584 | B2 | 6/2004 | Pham et al. | |
| 6,941,770 | B1 | 9/2005 | Taras et al. | |
| 6,966,193 | B2 | 11/2005 | Dobmeier et al. | |
| 6,973,797 | B2 | 12/2005 | Nemit, Jr. | |
| 8,079,229 | B2 | 12/2011 | Lifson et al. | |
| 8,511,103 | B2 | 8/2013 | Welch | |
| 8,671,703 | B2 | 3/2014 | Mitra et al. | |
| 9,062,903 | B2 | 6/2015 | Sjoholm et al. | |
| 9,121,627 | B2 | 9/2015 | Kopko et al. | |
| 9,134,058 | B2 | 9/2015 | Ikemiya et al. | |
| 9,316,424 | B2 | 4/2016 | Lin et al. | |
| 9,551,517 | B2 | 1/2017 | Arii | |
| 2004/0035122 | A1 | 2/2004 | Lifson et al. | |
| 2010/0236264 | A1 | 9/2010 | Lifson et al. | |
| 2010/0251750 | A1 | 10/2010 | Lifson et al. | |
| 2011/0132007 | A1 | 6/2011 | Weyna et al. | |
| 2011/0203299 | A1 * | 8/2011 | Jing | F25B 47/025 62/80 |
| 2012/0192579 | A1 | 8/2012 | Huff et al. | |
| 2012/0227427 | A1 | 9/2012 | Liu et al. | |

FOREIGN PATENT DOCUMENTS

| | | | |
|---|---|---|---|
| CN | 102272541 | A | 12/2011 |
| CN | 202267261 | U | 6/2012 |
| DE | 102013010672 | A1 | 12/2014 |
| EP | 1418390 | A1 | 5/2004 |
| JP | 2001263838 | A | 9/2001 |

OTHER PUBLICATIONS

International Search Report; PCT/US2018/036500; ISA/EPO; dated Aug. 21, 2018; 6 pages.

Written Opinion of the International Searching Authority; International Application No. PCT/US2018/036500; International Filing Date: Jun. 7, 2018; dated Aug. 21, 2018; 11 pages.

First Office Action; Chinese Application No. 201880051596.4; International Filing Date: Feb. 7, 2020; dated Jun. 3, 2021; 22 pages with translation.

Written Opinion of the Intellectual Property Office of Singapore; International Application No. 11201911797S; International Filing Date: Dec. 6, 2019; dated Feb. 26, 2021; 7 pages.

Chen Haiquan; "Ship auxiliary engine"; Dalian Maritime University Press; Nov. 2016; pp. 1-6.

Li Fan et al.; "Air source heat pump water heater"; Chongqing University Press; 2010; pp. 7-23.

Second Chinese Office Action; Chinese Application No. 201880051596.4; dated Sep. 15, 2021; 10 pages.

* cited by examiner

METHOD OF CONTROL FOR ECONOMIZER OF TRANSPORT REFRIGERATION UNITS

CROSS-REFERENCE TO RELATED APPLICATIONS

This application is a 371 U.S. National Stage application of PCT/US2018/036500, filed Jun. 7, 2018, which claims the benefit of U.S. Provisional Application No. 62/516,947, filed Jun. 8, 2017, both of which are incorporated by reference in their entirety herein.

BACKGROUND

The subject matter disclosed herein generally relates to transport refrigeration units and, more particularly, to control and operation of refrigeration units and systems using an economizer pump down cycle for improving the restart conditions to aid in reliability.

In a typical refrigeration system, compressor on-off cycles can be repeated to maintain desired temperatures within a container or other volume when excess compressor capacity exceeds load demand. The use of scroll type compressors has provided various advantages, but the repeated on-off economized mode operation can generate an increased flooding risk to the compressor. Accordingly, it may be advantageous to improve control and operation of scroll type compressors to minimize such adverse effects (e.g., liquid flood back through the economizer heat exchanger).

SUMMARY

According to one embodiment, a method of operating a refrigeration system includes initiating a compressor shutdown operation, determining a difference in a saturation temperature at a port of a compressor of the refrigeration system and an ambient temperature and comparing the difference in the saturation temperature and ambient temperature with a threshold. If the difference in the saturation temperature and ambient temperature is less than or equal to the threshold, a pump down operation is performed and if the difference in the saturation temperature and ambient temperature exceeds the threshold, a compressor shutdown operation is completed.

In addition to one or more of the features described herein, or as an alternative, further embodiments comprising calculating the saturation temperature at the port of the compressor.

In addition to one or more of the features described herein, or as an alternative, further embodiments calculating the saturation temperature is performed using the return air temperature to an evaporator of the refrigeration system.

In addition to one or more of the features described herein, or as an alternative, further embodiments the threshold is a predetermined limit of about 10 degrees Fahrenheit.

In addition to one or more of the features described herein, or as an alternative, further embodiments performing the pump down operation includes operating an electronic valve assembly of the refrigeration system.

In addition to one or more of the features described herein, or as an alternative, further embodiments operating the electronic valve assembly of the refrigeration system includes closing the electronic valve assembly to reduce a pressure within an evaporator of the refrigeration system.

In addition to one or more of the features described herein, or as an alternative, further embodiments the compressor includes an intermediate port associated with an economizer heat exchanger and operating the electronic valve assembly of the refrigeration system reduces a pressure at the intermediate port of the compressor.

In addition to one or more of the features described herein, or as an alternative, further embodiments the electronic valve assembly is located upstream from a compressor and/or downstream from an inlet of an evaporator.

In addition to one or more of the features described herein, or as an alternative, further embodiments the electronic valve assembly is a suction modulation valve.

In addition to one or more of the features described herein, or as an alternative, further embodiments the electronic valve assembly is an evaporator expansion valve.

According to another embodiment, a method of operating a refrigeration system includes anticipating operation of the refrigeration system in an economizer mode, determining a difference in a saturation temperature at a port of a compressor of the refrigeration system and an ambient temperature, and comparing the difference in the saturation temperature and ambient temperature with a threshold. If the difference in the saturation temperature and ambient temperature is less than or equal to the threshold, a pump down operation is performed and if the difference in the saturation temperature and ambient temperature exceeds the threshold, operation of the refrigeration system in the economizer mode is initiated.

According to yet another embodiment, a refrigeration system includes a compressor, an evaporator fluidly connected to a suction port of the compressor, an economizer heat exchanger fluidly coupled to an intermediate port of the compressor, and a control valve operable to control fluid flow to or from the evaporator. A controller associated with the control valve is operable to determine a difference in a saturation temperature at the suction port of a compressor and an ambient temperature, and compare the difference in the saturation temperature and ambient temperature with a threshold. If the difference in the saturation temperature and ambient temperature is less than or equal to the threshold, a pump down operation is performed. If the difference in the saturation temperature and ambient temperature exceeds the threshold, operation of the refrigeration system in the economizer mode is initiated.

In addition to one or more of the features described herein, or as an alternative, further embodiments the compressor is a scroll type compressor.

In addition to one or more of the features described herein, or as an alternative, further embodiments the pump down operation includes operating the control valve of the refrigeration system.

In addition to one or more of the features described herein, or as an alternative, further embodiments operating the control valve of the refrigeration system includes closing the control valve to reduce a pressure at the intermediate port of the compressor.

In addition to one or more of the features described herein, or as an alternative, further embodiments the control valve is an evaporator expansion valve.

In addition to one or more of the features described herein, or as an alternative, further embodiments the control valve is a suction modulation valve.

In addition to one or more of the features described herein, or as an alternative, further embodiments the system is operable in a normal mode and an economizer mode.

In addition to one or more of the features described herein, or as an alternative, further embodiments in the economizer mode, fluid is provided from the economizer heat exchanger to the intermediate port of the compressor.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
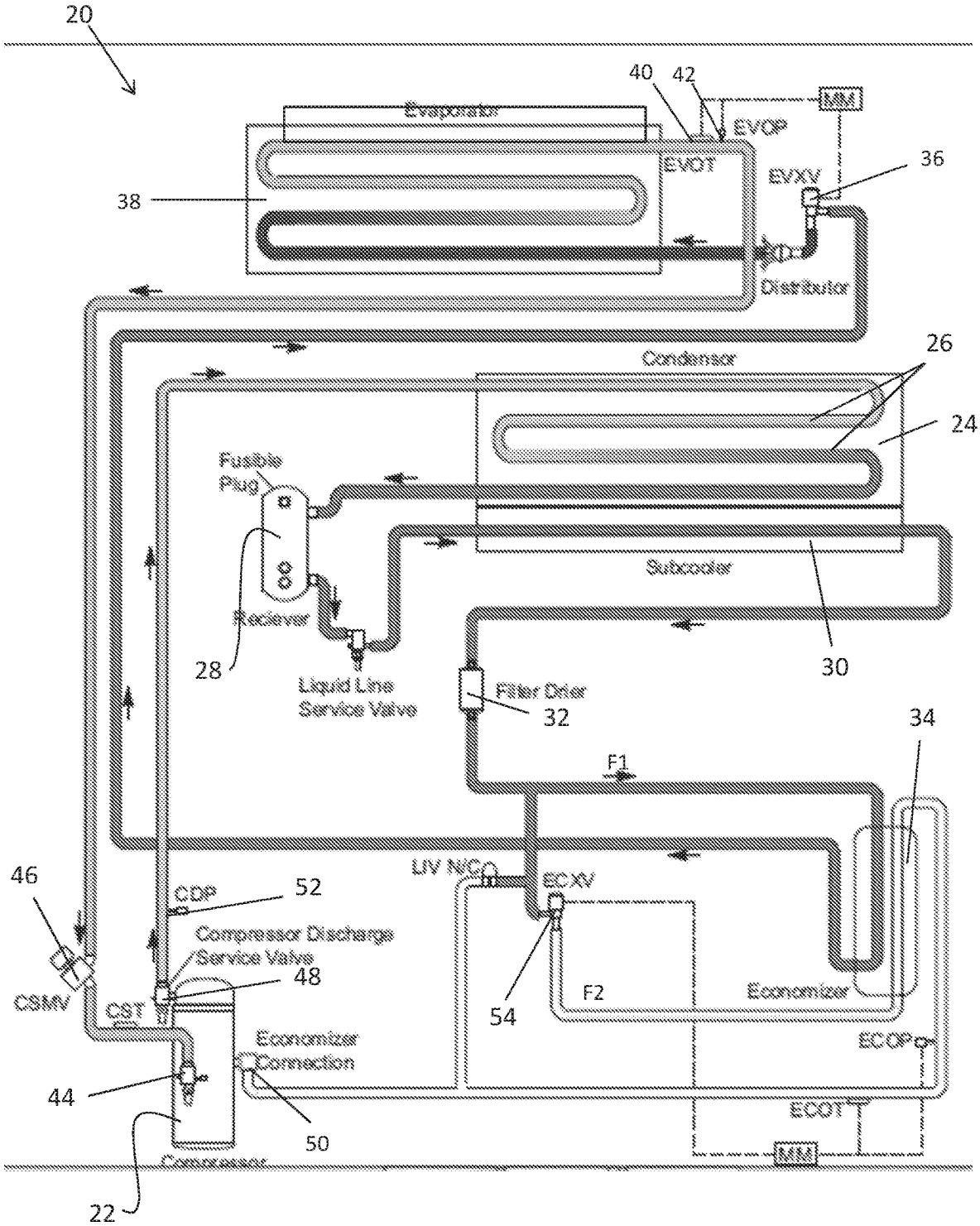
FIG. 1 is a schematic illustration of a transport refrigeration unit in accordance with an example embodiment of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

With reference now to FIG. 1, a schematic representation of an example of a transport refrigeration unit 20 is illustrated. As shown, the transport refrigeration unit 20 includes a compressor 22. In some refrigeration system configurations, the compressor 22 may be, for example, a scroll type compressor that may be modulated via digital modulation of the scroll wraps or suction gas modulation of via a suction gas throttling valve. Such scroll type compressors may be subject to stresses or even failure due to liquid flood back and slugging from an economizer stage heat exchanger. Liquid refrigerant can puddle in plate-type heat exchangers and/or the tubing associated therewith when the system does not require the additional cooling provided by the economizer heat exchanger at lower ambient conditions. Scroll type compressors may be subject to repeated cycling (on/off) due to excess capacity. When installed with a box container to be cooled by a refrigeration system having a scroll type compressor, conditions may exist that are based on the temperature of the box container. As will be appreciated by those of skill in the art, the scroll type compressor can be any scroll type compressor (e.g., fixed scroll, orbital scroll, etc.). Although a scroll type compressor is described herein, it should be understood that other types of compressors, such as reciprocating or screw compressors are also within the scope of the disclosure.

High temperature, high pressure refrigerant vapor exits a discharge port of the compressor 22 and moves to a heat rejecting heat exchanger 24 (i.e. a condenser or gas cooler) which includes a plurality of condenser coil fins and tubes 26, which receive air, typically blown by a heat rejecting heat exchanger (not shown). By removing latent heat through this step, the refrigerant condenses to a high pressure/high temperature liquid and flows to the receiver 28 that provides storage for excess liquid refrigerant during low temperature operation. From the receiver 28, the refrigerant flows to a subcooler 30, which increases the refrigerant subcooling. The subcooler 30 may be positioned adjacent the heat rejecting heat exchanger 24, and cooled by an air flow from the heat rejecting heat exchanger fan. A filter-drier 32 keeps the refrigerant clean and dry, and outlets refrigerant to a first refrigerant flow path F1 of an economizer heat exchanger 34. Within the first refrigerant flow path F1, the subcooling of the refrigerant is increased. In an embodiment, the economizer heat exchanger 34 may be a plate-type heat exchanger, providing refrigerant to refrigerant heat exchange between the first refrigerant flow path F1 and a second refrigerant flow path F2.

From the first refrigerant flow path F1, refrigerant flows from the economizer heat exchanger 34 to an evaporator expansion device 36. The evaporator expansion device 36 is associated with an evaporator 38 and is operable to control a flow of refrigerant to the evaporator 38. The evaporator expansion device 36 is controlled by a controller, illustrated schematically at MM, in response to signals from an evaporator outlet temperature sensor 40 and an evaporator outlet pressure sensor 42. An evaporator fan (not shown) is operable to draw or push air over the evaporator 38 to condition the air in a compartment associated with the transport refrigeration unit 20. Refrigerant output from the evaporator 38 travels along to a compressor inlet path to a compressor suction port 44.

In the illustrated, non-limiting embodiment, the unit 20 additionally includes a compressor suction modulation valve 46 and a compressor suction service valve 48. The suction modulation valve 46 is operably controlled by the electronic controller and is arranged within the refrigerant flow path, downstream from the evaporator heat exchanger 38. The electronic controller can be configured to perform operations as described herein to control operation of the suction modulation valve 46. As will be appreciated by those of skill in the art, such configuration can include additional features and components, such as a thermal expansion valve and/or other components, which are not shown for simplicity. In some embodiments, the evaporator expansion valve 36 can be replaced or substituted with the compressor suction modulation valve 46 to control the flow through the evaporator heat exchanger 38. Alternatively, in some embodiments, the refrigeration unit 20 can include an evaporator expansion valve 36, a suction modulation valve(s) 46, and/or other valves as known in the art.

The refrigeration system 20 further includes a second refrigerant flow path F2 through the economizer heat exchanger 34. The second refrigerant flow path F2 is connected between the first refrigerant flow path F1 and an intermediate inlet port 50 of the compressor 22. The intermediate inlet port 50 is located at an intermediate location along a compression path between compressor suction port 44 and compressor discharge port 52.

An economizer expansion device 54 is positioned in the second refrigerant flow path F2, upstream of the economizer heat exchanger 34. The economizer expansion device 54 may be an electronic economizer expansion device controlled by the controller. When the economizer 34 is active, the controller controls the economizer expansion device 54 to selectively allow refrigerant to pass through the second refrigerant flow path F2, through the economizer heat exchanger 34 and to the intermediate inlet port 50. The economizer expansion device 54 serves to expand and cool the refrigerant which proceeds into the economizer counterflow heat exchanger 34, thereby subcooling the liquid refrigerant in the first refrigerant flow path F1 proceeding to the evaporator expansion device 36.

Those of skill in the art will appreciate that the schematics and configuration shown in FIG. 1 are merely an example of a refrigeration unit and are not intended to be limiting. For example, other components or configurations are possible with departing from the scope of the present disclosure. For example, refrigeration systems may include controllers, receivers, filters, dryers, additional valves, heat exchangers, sensors, indicators, etc. without departing from the scope of the present disclosure.

During operation of the transport refrigeration unit 20 under a normal load, i.e. at low capacity to maintain a stable temperature equal to a desired product storage temperature, the economizer expansion device 54 is in a closed position. With the economizer expansion device 54 in the closed position, no refrigerant flows through the second refrigerant flow path F2 to the compressor 22. Rather, all of the refrigerant flows through the first refrigerant flow path F1 to the evaporator expansion device 36. Thus, the amount of refrigerant passing through the evaporator heat exchanger coil 38 is adjusted and controlled by the evaporator expansion device 36 in a conventional manner.

When the transport refrigeration unit 20 is operating at a high capacity, for example when the temperature of the container is above the desired product storage temperature, the controller will transform the economizer expansion device 54 to an open position. In the open position, refrigerant is permitted to flow through both the first refrigerant flow path F1 and the second refrigerant flow path F2. The refrigerant within the first refrigerant flow path F1 flows through the economizer heat exchanger 34 and the evaporator 36 before being returned to a compressor suction port 52. The refrigerant within the second refrigerant flow path F2 passes from the economizer heat exchanger 34 directly to an intermediate suction port 50 of the compressor 22, thereby bypassing the evaporator expansion device 36 and evaporator heat exchanger 38.

To address the part life of scroll type compressors 22, embodiments provided herein are directed to controlling operating conditions to provide less stress on scroll type compressors. That is, control systems and operations can be performed in accordance with the present disclosure to establish favorable conditions for refrigeration units 20 that include scroll type compressors. One or more of the electronic valve assemblies described above (i.e. the evaporator expansion device 36 or the suction modulation device 46), and as known in the art, can be controlled to perform a pump down operation to achieve desired conditions. For example, when using an evaporator expansion device 36, a pump down operation can be performed to pump down the compressor suction pressure. As such, the electronic valve assembly as used herein can include various types of electronic valves and can be positioned in various locations along a flow path through a refrigeration unit, without departing from the scope of the present disclosure.

In accordance with various embodiments of the present disclosure, an electronic valve assembly (e.g., electronic expansion valve 36, suction modulation valve 46, etc.) is controlled or otherwise utilized to perform a controlled "low-side" pump-down prior to a compressor-shutdown operation or prior to operation in an economizer mode to adjust the compressor suction pressure at the intermediate port 50 to a lower, more desirable state.

For example, in one non-limiting example, the electronic valve assembly, such as the evaporator expansion device 36, is closed while the compressor 22 is running. Such closure will pump some of the refrigerant out of the evaporator 38, thereby lowering the evaporator pressure, and the corresponding compressor suction pressure at port 44, and the corresponding pressure at the economizer port 50. With a tight evaporator control valve 36 and compressor 22, the more desirable low pressure condition can be established prior to shutting down the compressor. The lower pressure condition will aid in boiling off excess liquid refrigerant accumulated within the economizer heat exchanger 34. As a result, the compressor stress during the next economizer mode restart condition is reduced by limiting the liquid flood back potential at the middle stage economizer port connection 50.

Figure 2:
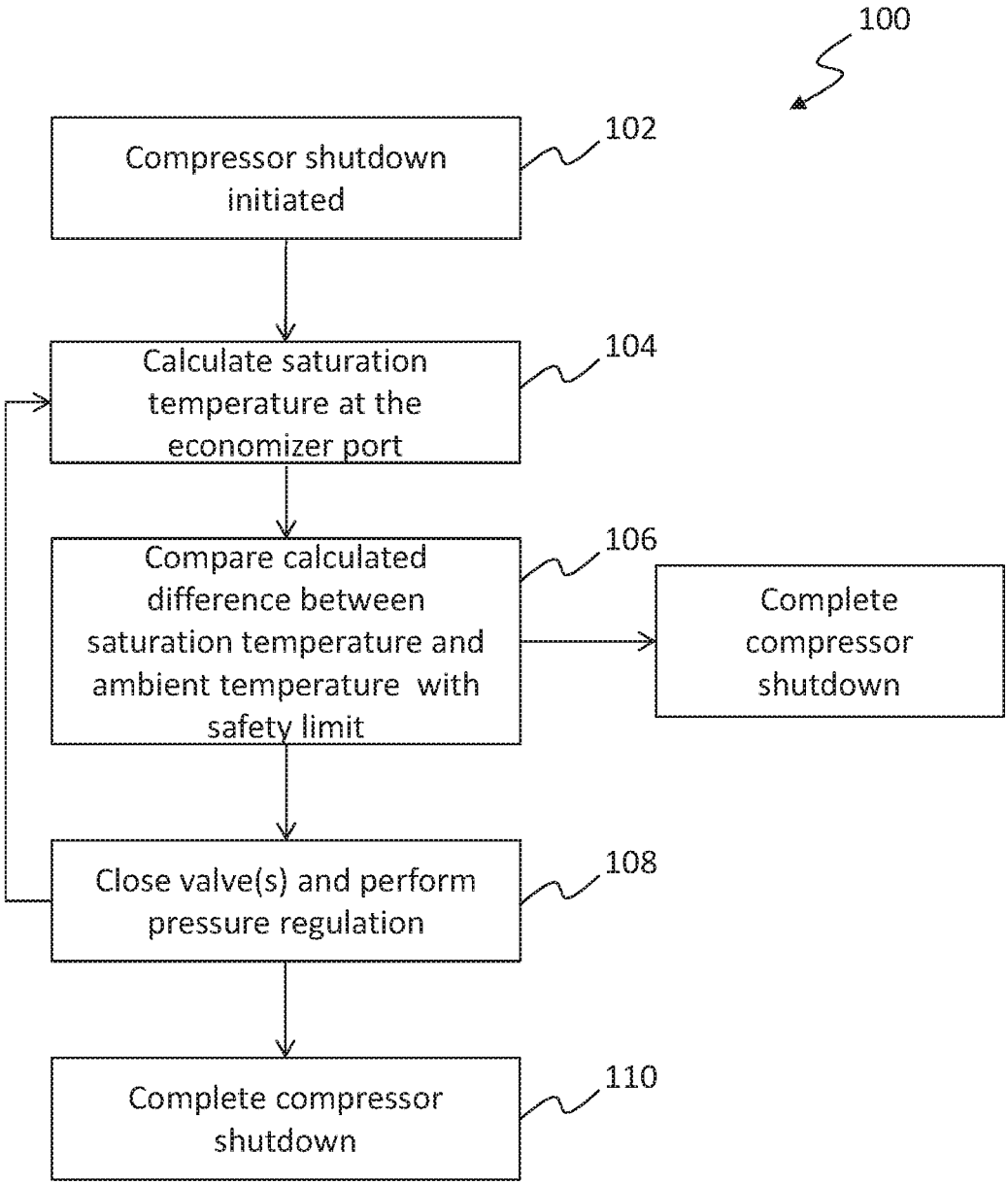
FIG. 2 is a method of operating a transport refrigeration unit according to an embodiment.

Turning now to FIG. 2, a process 100 for controlling a refrigeration unit 20 and in particular an electronic valve assembly, in accordance with a non-limiting embodiment of the present disclosure is shown. The flow process 100 can be performed using one or more controllers. The controller(s) can be operably connected to various sensors, actuators, electrical systems, etc. such that the information and data required to perform the flow process described herein can be provided thereto. Further, the controller(s) can include processors, memory, and other components as will be appreciated by those of skill in the art. The process 100 can be used with refrigeration units 20 as described above and/or variations thereon.

At block 102, the refrigeration system initiates a compressor shutdown operation. The compressor shutdown operation can be initiated by the controller when the controller detects one or more of various predetermined conditions that require a compressor shutdown. For example, the compressor shutdown may be initiated based on internal temperatures of a container box or a defrost operation is to be performed.

At block 104, the controller calculates a saturated evaporator/suction temperature. The saturated evaporator/suction temperature is based on the return air temperature at the evaporator. The saturated evaporator/suction temperature is an indication of what the evaporator and/or suction pressure could be at the next restart condition based on the return air temperature at the time of shutdown.

In an embodiment, the saturation temperature is calculated using an economizer output pressure, which is indicative of the pressure at the intermediate port 50. At block 106, a difference between the saturation temperature and the ambient air temperature is compared to a safety limit. The ambient air temperature is the air temperature external to the container (e.g., air that is pulled into the refrigeration system for heat exchange or mixing with return air).

The safety limit may be predefined or selected based on the specific refrigeration system being used, based on cargo to be cooled within the container, based on expected ambient conditions (e.g., transport and/or storage of the container such that weather or other variables may be considered). The safety limit is predefined to ensure that operation of the compressor is not attempted at conditions that may damage the compressor or impart unnecessary loads or stresses on the system. The safety limits are readily appreciated by those of skill in the art and can depend on compressor configurations, box conditions, product or cargo conditions and/or requirements, air temperatures, air densities, ambient or environmental (e.g., exterior) conditions, etc. If the difference between the saturation temperature and the ambient temperature is greater than the predetermined threshold, the compressor shutdown will proceed. If the difference between the saturation temperature and the ambient temperature is less than or equal to the predetermined threshold, such as ten degrees Fahrenheit for example, the compressor is not shutdown, but rather a pump down operation is performed.

In block 108, a pump down operation is performed by controlling an electronic valve assembly of the system. The electronic expansion valve or the suction modulation valve is at least partially closed to restrict a flow into the evaporator, thereby reducing the evaporator pressure. Because the evaporator 38 is fluidly coupled to the compressor suction inlet 44, a reduction in the evaporator pressure will cause a similar reduction in the compressor suction pressure at the intermediate suction port 50. By proactively closing the electronic valve assembly, the refrigerant can be drained through a pump down operation and/or a suction operation to pre-condition the pressure within the refrigeration system in anticipation of the next restart operation. Once the pump down operation has been performed, the flow process will continue to block 110. At block 110, the compressor shutdown operation will be completed, and the compressor will be turned off.

Figure 3:
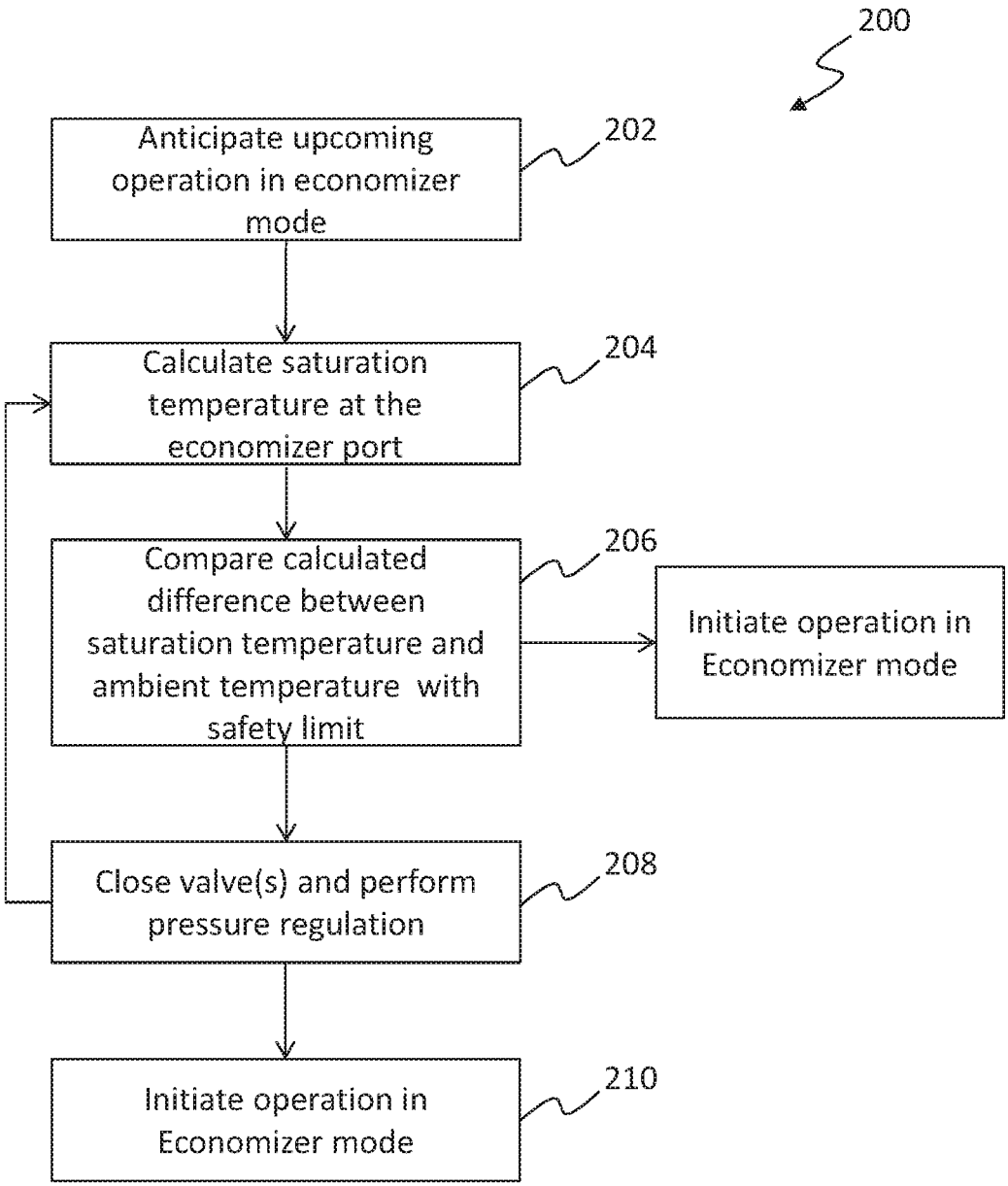
FIG. 3 is a method of operating a transport refrigeration unit according to another embodiment.

In an alternate embodiment, shown in FIG. 3, the pressure regulation may be performed during operation of the system 20. For example, the method 200 includes anticipating upcoming use of the transport refrigeration unit in an economizer mode, shown in block 202. In response to the anticipated economizer mode, the controller determines a saturated evaporator/suction temperature, shown in block 204. In block 206, a difference between the saturated temperature and the ambient temperature is calculated to determine if the difference exceeds a safety limit. If the difference does exceed the safety limit, a pump down operation is performed, as shown in block 208, by controlling an electronic valve assembly of the system 2 as previously described. Once the pump down operation has been performed, and the compressor suction pressure has been reduced, the flow process will continue to block 210, where operation in the economizer mode is initiated.

Advantageously, embodiments illustrated and described herein provide a refrigeration system with improved compressor life and reliability by reducing the potential for flooding or slugging at the middle stage port of the compressor of refrigeration units that incorporate compressors as described herein.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although only one simple configuration of a refrigeration system is shown and described, those of skill in the art will appreciate that other components and/or features may be added to the system without departing from the scope of the disclosure. Further, configurations of the components may be used without departing from the scope of the disclosure. Moreover, although described in a specific order of steps and/or timeliness, those of skill in the art will appreciate that these are merely examples, and the process may be varied depending on the needs and configurations that employ the process.

Accordingly, the present disclosure is not to be seen as limited by the foregoing description, but is only limited by the scope of the appended claims.

What is claimed is:

1. A method of operating a refrigeration system comprising:

initiating a compressor shutdown operation;

determining a difference in a saturation temperature at an intermediate port of a compressor of the refrigeration system and an ambient temperature, the intermediate port being associated with an economizer heat exchanger; and comparing the difference in the saturation temperature and ambient temperature with a threshold;

wherein in response to determining that the difference in the saturation temperature and ambient temperature is less than or equal to the threshold, initiating a pump down operation and then completing the compressor shutdown operation;

wherein in response to determining that the difference in the saturation temperature and ambient temperature exceeds the threshold, completing the compressor shutdown operation; and wherein performing the pump down operation includes closing an electronic valve assembly of the refrigeration system to reduce a pressure at the intermediate port of the compressor.

2. The method of claim 1, further comprising calculating the saturation temperature at the port of the compressor.

3. The method of claim 2, wherein calculating the saturation temperature is performed using the return air temperature to an evaporator of the refrigeration system.

4. The method of claim 1, wherein the threshold is a predetermined limit of about 10 degrees Fahrenheit.

5. The method of claim 1, wherein the electronic valve assembly is located upstream from a compressor and/or downstream from an inlet of an evaporator.

6. The method of claim 5, wherein the electronic valve assembly is a suction modulation valve.

7. The method of claim 5, wherein the electronic valve assembly is an evaporator expansion valve.

8. A method of operating a refrigeration system for cooling a container comprising:

during operation of the refrigeration system, determining that a temperature of the controller is above a desired product storage temperature;

determining a difference in a saturation temperature at a port of a compressor of the refrigeration system and an ambient temperature; and comparing the difference in the saturation temperature and ambient temperature with a threshold;

wherein in response to determining that the difference in the saturation temperature and ambient temperature is less than or equal to the threshold, initiating a pump down operation including closing an electronic valve assembly; and in response to determining that the difference in the saturation temperature and ambient temperature exceeds the threshold, initiating operation of the refrigeration system in the economizer mode, wherein initiating operation of the refrigeration system in the economizer mode further comprises opening an economizer expansion valve associated with an economizer heat exchanger.

9. The method of claim 8, wherein the compressor is operational during the method.

10. A refrigeration system comprising:

a compressor;

an evaporator fluidly connected to a suction port of the compressor;

an economizer heat exchanger fluidly coupled to an intermediate port of the compressor;

a control valve operable to control fluid flow to or from the evaporator, the control valve being located such that all of the fluid flow provided to the evaporator passes therethrough; and a controller associated with the control valve, the controller being configured to:

determine a difference in a saturation temperature at the suction port of a compressor of the refrigeration system and an ambient temperature; and compare the difference in the saturation temperature and ambient temperature with a threshold;

wherein in response to determining that the difference in the saturation temperature and ambient temperature is less than or equal to the threshold, the controller closes the control valve to initiate a pump down operation; and wherein in response to determining that the difference in the saturation temperature and ambient temperature exceeds the threshold, the controller initiates operation of the refrigeration system in the economizer mode by opening an economizer expansion valve associated with the economizer heat exchanger.

11. The system of claim 10, wherein the compressor is a scroll type compressor.

12. The system of claim 10, wherein closing the control valve reduces a pressure at the intermediate port of the compressor.

13. The system of claim 12, wherein the control valve is an evaporator expansion valve.

14. The system of claim 12, wherein the control valve is a suction modulation valve.

15. The system of claim 10, wherein the system is operable in a normal mode and the economizer mode.

16. The system of claim 10, wherein in the economizer mode, fluid is provided from the economizer heat exchanger to the intermediate port of the compressor.

* * * * *